US010675200B2

(12) United States Patent
Shokoufandeh

(10) Patent No.: US 10,675,200 B2
(45) Date of Patent: Jun. 9, 2020

(54) BODYWEIGHT DECOMPRESSION TABLE

(71) Applicant: Mani Shokoufandeh, Marina Del Rey, CA (US)

(72) Inventor: Mani Shokoufandeh, Marina Del Rey, CA (US)

( * ) Notice: Subject to any disclaimer, the term of this patent is extended or adjusted under 35 U.S.C. 154(b) by 50 days.

(21) Appl. No.: 15/679,377

(22) Filed: Aug. 17, 2017

(65) Prior Publication Data

US 2018/0049936 A1 Feb. 22, 2018

Related U.S. Application Data

(60) Provisional application No. 62/494,757, filed on Aug. 18, 2016.

(51) Int. Cl.
*A61G 13/00* (2006.01)
*A61H 1/02* (2006.01)

(52) U.S. Cl.
CPC ..... *A61G 13/009* (2013.01); *A61H 1/0222* (2013.01); *A61H 1/0229* (2013.01); *A61G 2200/327* (2013.01); *A61G 2200/36* (2013.01); *A61G 2210/10* (2013.01); *A61H 2201/0138* (2013.01); *A61H 2203/0443* (2013.01)

(58) Field of Classification Search
CPC ..... A61H 1/0229; A61H 2201/0192; A61H 2201/1284; A61H 2201/1619; A61H 2201/1614; A61H 2201/1642; A61H 2201/1652; A61H 2201/169; A61H 2201/1628; A61H 2203/0493; A61G 13/122; A61G 13/04; A61G 13/009; A61G 13/125
See application file for complete search history.

(56) References Cited

U.S. PATENT DOCUMENTS 3,561,434 A * 2/1971 Kilbey ..... A61F 5/24 602/36
4,865,022 A * 9/1989 Gorsen ..... A61H 1/0218 602/33
5,207,627 A * 5/1993 Doran ..... A61H 1/0218 482/114
5,637,079 A * 6/1997 Miller ..... A61H 1/0218 601/23
5,772,622 A * 6/1998 Friske ..... A61H 1/0218 428/99
5,807,218 A * 9/1998 Nagatomo ..... A61F 5/3715 128/869
5,951,443 A * 9/1999 Askins ..... A63B 23/047 482/124
6,213,923 B1 * 4/2001 Cameron ..... A63B 21/012 297/50

(Continued)

*Primary Examiner* — Garrett K Atkinson
(74) *Attorney, Agent, or Firm* — Mark Rodgers

(57) ABSTRACT

Decompression table embodiments are described that provide body weight support distributed along the body by providing a lumbar support harness as well as separate foot and leg attachment elements, Other embodiments may either alone or in combination with body weight support elements may provide elements for placing the body in a pre-stretched configuration during decompression by curving the body support portion of the table and strategically adding controlled spacing from the cervical and lumbar areas to the table surface.

9 Claims, 5 Drawing Sheets

(56) References Cited

U.S. PATENT DOCUMENTS 6,464,296 B1 * 10/2002 Sumner ..... A47C 3/0255 297/326
7,044,896 B2 * 5/2006 Hetrick ..... A63B 21/00043 482/95
7,282,039 B2 * 10/2007 Henke ..... A61F 5/04 602/32
7,597,656 B2 * 10/2009 Trees ..... A61H 1/0229 482/142
7,625,326 B2 * 12/2009 Teeter ..... A61H 1/0218 482/144
7,722,508 B2 * 5/2010 Hetrick ..... A63B 21/0023 482/139
7,887,499 B2 * 2/2011 Cogswell ..... A61F 5/3715 602/23
7,955,236 B2 * 6/2011 DiGiovanni ..... A63B 21/0552 482/124
8,043,197 B2 * 10/2011 Hetrick ..... A63B 21/0023 482/91
8,062,198 B2 * 11/2011 Wei ..... A61H 1/0218 482/144
8,539,621 B2 * 9/2013 West ..... A61F 5/3776 5/621
8,556,787 B2 * 10/2013 Leier ..... A61H 1/0222 482/144
8,601,623 B1 * 12/2013 West ..... A61F 5/3776 5/621
8,721,509 B1 * 5/2014 Berdut-Teruel ..... A63B 21/068 482/121
8,944,976 B2 * 2/2015 Crowell ..... A63B 21/0442 482/121
9,216,311 B2 * 12/2015 Champion ..... A63B 21/151
9,433,550 B2 * 9/2016 Winternheimer ..... A61H 1/005
9,526,667 B1 * 12/2016 Wang ..... A61H 1/0229
9,687,406 B1 * 6/2017 Steiner ..... A61H 1/0218
9,801,774 B2 * 10/2017 Noel ..... A61H 1/0229
10,035,039 B1 * 7/2018 Jui ..... A63B 21/4035
10,105,276 B2 * 10/2018 Chong ..... A61H 1/0229
10,105,277 B2 * 10/2018 Chong ..... A61H 1/0229
2003/0114275 A1 * 6/2003 Falbo, Sr. ..... A63B 22/0605 482/57
2003/0195092 A1 * 10/2003 Basting ..... A63B 21/0552 482/124
2006/0161084 A1 * 7/2006 Henke ..... A61F 5/04 602/32
2006/0178607 A1 * 8/2006 Evans ..... A61F 5/3776 602/33
2008/0177211 A1 * 7/2008 Boren ..... A61H 1/0218 602/32
2009/0054216 A1 * 2/2009 Teeter ..... A61H 1/0218 482/144
2009/0054217 A1 * 2/2009 Teeter ..... A61H 1/0218 482/144
2009/0124473 A1 * 5/2009 Teeter ..... A61H 1/0218 482/144
2013/0059705 A1 * 3/2013 Leier ..... A61H 1/0222 482/144
2013/0143723 A1 * 6/2013 Bender ..... A63B 21/0552 482/121
2013/0327339 A1 * 12/2013 Chua ..... A61G 13/04 128/845
2013/0333116 A1 * 12/2013 West ..... A61F 5/3776 5/623
2014/0150803 A1 * 6/2014 Gold ..... A61G 99/00 128/845
2015/0065319 A1 * 3/2015 Wald ..... A61F 5/042 482/132
2015/0305962 A1 * 10/2015 Noel ..... A61H 1/0229 602/36
2016/0228320 A1 * 8/2016 Mabry ..... A61H 1/0229
2016/0361586 A1 * 12/2016 Wang ..... A61H 1/0229
2017/0239123 A1 * 8/2017 Wang ..... A61H 1/003
2018/0147107 A1 * 5/2018 Leier ..... A61H 1/0222
2018/0250186 A1 * 9/2018 Leier ..... A61H 1/0229
2018/0271737 A1 * 9/2018 Leier ..... A61H 1/0229

* cited by examiner

BODYWEIGHT DECOMPRESSION TABLE

RELATED APPLICATIONS

This application claims priority to U.S. Provisional Application, Ser. No. 62/494,757, filed Aug. 18, 2016, the contents of which are incorporated by reference in their entirety.

BACKGROUND

This disclosure relates to a therapeutic and body weight decompression table and in particular to a decompression table with built in positioning features for beneficial body stretching working alone or in concert with decompression Decompression and opening of spaces between the lumbar spine vertebrae provides many benefits in the treatment of back issues. Such decompression may decrease pressure on the spinal nerves and increase the blood circulation and nutrients to the lumbar spine disc to prevent complications that occur in the lower back due poor biomechanics, posture, repetitive trauma, injuries and physical stress. Combining decompression with body positioning leading to controlled stretching of certain body parts may be beneficial for many neck and back ailments.

SUMMARY

Decompression table embodiments may be provided that provide body weight support distributed along the body by providing a lumbar support harness as well as separate foot and leg attachment elements. Other embodiments may either alone or in combination with body weight support elements provide elements for placing the body in a pre-stretched configuration either separately or during decompression by curving the body support portion of the table and strategically adding controlled spacing from the cervical and lumbar areas to the table surface.

In a first aspect, a body weight decompression table may be provided including: a leg extension portion connected to a user support table surface at an axis point, the table extension and user support portions configured to be pivoted around the axis point in controllable increments; a lumbar support harness configured to be secured around a user's waste; a cable, whose length is adjustable, connected to the lumbar support harness at one end and anchored to the leg extension portion at the other end; and, leg and foot attachment elements disposed at one end of the table surface, The leg and foot elements may include a leg stabilizer configured for initial user foot placement on the table surface; and footstraps configured for user foot placement once the user is secured on the table with the harness in a leg bent configuration.

In one embodiment of the first aspect the user support table surface may be curved, the curve comprising a continuous smooth curve with a center deviation from flat of between 4 and 12 inches. In another embodiment of the first aspect, the center deviation from flat may be 6 inches. In one embodiment of the first aspect the table surface may include attachment points for orthotics in at least one of the cervical region of the surface and the lumbar region of the table surface.

In another embodiment of the first aspect, the orthotics may include padded structures configured to raise the effective user-to-table separation in at least one of the cervical and lumbar regions of the table surface. In one embodiment of the first aspect the orthotics may be less than the table surface width in width, and the lumbar region orthotic is between 4.5 to 6 inches in length and the cervical region orthotic is between 3.5 and 5 inches in length. In another embodiment of the first aspect, the cervical orthotics may be between 3 and 6 inches in height and the lumbar orthotics may be between 2 and 5 inches in height.

In one embodiment of the first aspect the table may include support legs and a pivot mechanism at the axis point configured to lock and unlock the table at each incremental rotation point. In one embodiment of the first aspect the table surface, legs, pivot mechanism and other components may be made from lightweight materials including, at least one of fiberglass, aluminum, carbon fiber, and titanium.

In a second aspect, a body weight decompression table may be provided including: a user support surface wherein the support surface is curved, the curve which may include a continuous smooth curve with a center deviation from flat of between 4 and 12 inches; and, the support surface may include attachment points for orthotics in at least one of the cervical region of the surface and the lumbar region of the table surface. In one embodiment of the second aspect the table support surface is connected to a leg extension portion at an axis point, the support and extension surfaces configured to be pivoted around the axis point; and the table may further include; a lumbar support harness configured to be secured around a user's waste; a cable, whose length is adjustable, connected to the lumbar support harness at one end and anchored to the leg extension portion at the other end; and, leg and foot elements disposed at one end of the table surface, which may include a leg stabilizer configured for initial user foot placement on the table surface; and footstraps configured for user foot placement once the user is secured on the table with the harness in a leg bent configuration.

In another embodiment of the second aspect the center deviation from flat may be 6 inches. In one embodiment of the second aspect the orthotics may include padded structures configured to raise the effective user to table separation in at least one of the cervical and lumbar regions of the table surface. In another embodiment of the second aspect the orthotics may be less than the table surface width in width and the lumbar region orthotic is between 4.5 to 6 inches in length and the cervical region orthotic is between 3.5 and 5 inches in length. In one embodiment of the second aspect the cervical orthotics maybe between 3 and 6 inches in height and the lumbar orthotics are between 2 and 5 inches in height.

In another embodiment of the second aspect the table may include support legs and a pivot mechanism at the axis point configured to lock and unlock the table at each incremental rotation point. In one embodiment of the second aspect the harness cable may include a series of hooking points disposed along its length configured to mate with a hook on the table thereby providing cable length adjustment.

In one embodiment of the second aspect the table surface, legs, pivot mechanism and other components maybe made from lightweight material including at least one of, fiberglass, aluminum, carbon fiber, and titanium. In another embodiment of the second the user support portion, leg extension portion and table support legs fold and collapse into a compact stowed configuration.

In a third aspect method may be provided for using an invertible decompression table with a curved user support surface, a leg extension, a lumbar harness, harness restraint cable, and attachment points for orthotic spacers in the cervical and lumbar regions of a user, including; connecting the restraint cable to the harness and to the leg extension with the table in an upright position and the user standing on the ground with legs in a leg stabilizer on the leg extension; rotating the table to a substantially horizontal position; placing the user's feet optionally in attachment elements in a bent knee position; inserting optionally at least one of a cervical and a lumbar spacing orthotic between the use and the table; and; inverting the table toward an upright position to the extent desirable.

BRIEF DESCRIPTION OF THE DRAWINGS

Aspects and advantages of the embodiments provided herein are described with reference to the following detailed description in conjunction with the accompanying drawings. Throughout the drawings, reference numbers may be re-used to indicate correspondence between referenced elements. The drawings are provided to illustrate example embodiments described herein and are not intended to limit the scope of the disclosure.

DETAILED DESCRIPTION OF ILLUSTRATIVE EMBODIMENTS

The current disclosure is directed to a body weight decompression table in which the table may be positionable to place the person in an inverted position allowing the vertebrae and spine to decompress and including an apparatus that secures the patient's body to the table at or around the mid-section to allow for increased decompression of the vertebrae and spine when the table is inverted vertically and distributing the body weight load so that all the weight is not borne by the feet and legs.

In addition to inverting the position, the current disclosure is further directed to placing the body in a predetermined stretch position on the table. A combination of curving the surface of the table in an inverse curve, i.e. a moderate backbend position, may extend and stretch the spine during in any table orientation, including inverted positions. The pre-stretch can be further adjusted with optional orthotic spacers of varying heights in the cervical and lumbar region of the table, to customize the pre-stretch to the capabilities of the user.

Further the current disclosure is directed to embodiments wherein the table is constructed of materials that are very light and are configured to collapse and stow efficiently.

In some embodiments an invertible decompression table is provided with a lumbar support harness connected to the table. Advantageously this arrangement more evenly distributes the bodyweight during inversion.

In some embodiments an invertible decompression table is provided with an leg stabilizer used while the user is attaching the lumbar harness, and footstraps or foot retaining elements, possibly compliant, in a bent knee position once the user is harnessed to the table. Advantageously this arrangement more evenly distributes the body weight during inversion and improves the body configuration of the user during decompression.

In some embodiments an invertible decompression table is provided with a backwardly curved body support surface and optional lumbar and/or cervical orthotic spacers. Advantageously this arrangement improves the treatment of the cervical, and lumbar areas of the body and is configurable to individual user flexibility levels.

In some embodiments an invertible decompression table is provided made from very light materials and designed to collapse into a small stowed configuration. Advantageously this arrangement makes use of the table practical in a wide variety of settings.

Figure 1:
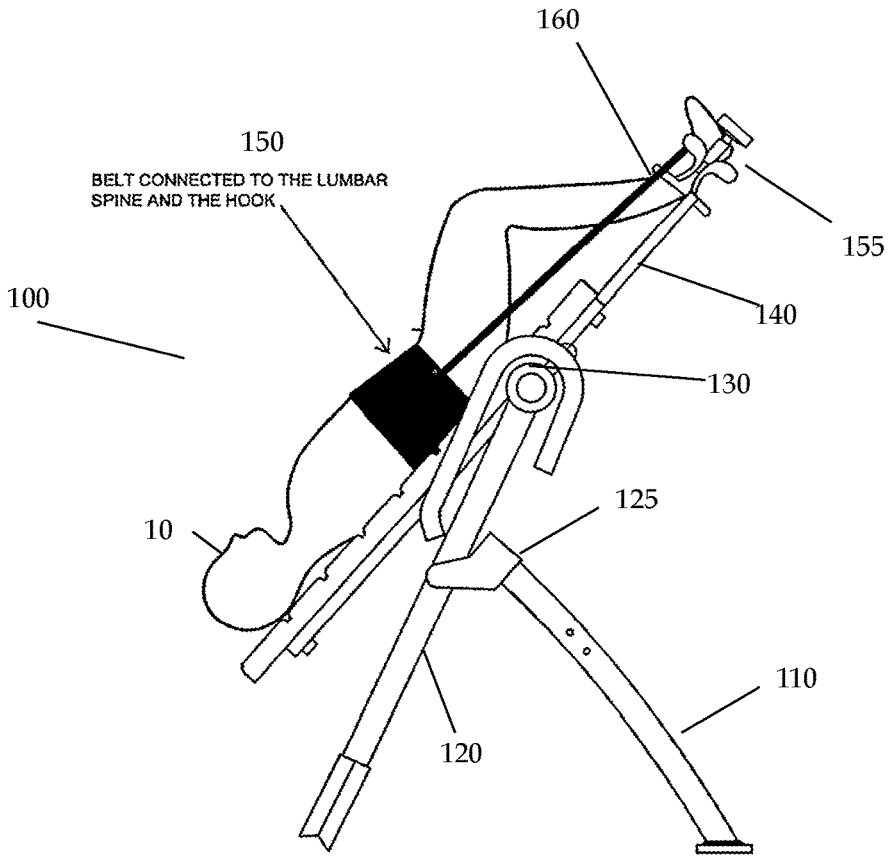
FIG. 1 shows an exemplary embodiment of a body weight decompression table.
Figure 2:
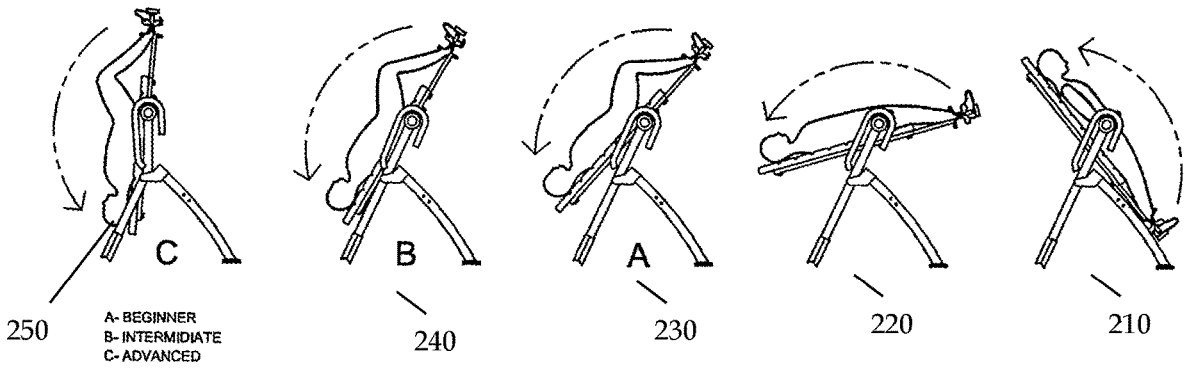
FIG. 2 shows exemplary positions of a body weight decompression table.

Referring to FIG. 1, an exemplary body weight decompression table 100 is shown that has a base frame having a front leg 110 and a back leg 120. The front leg 110 and back leg 120 are connected 125. Other table leg configurations may be implemented consistently with the present disclosure. For example, the legs may be configured to have a base in between them. In other embodiments, more than two legs may be utilized The back leg 110 of the table may extend beyond the connection 125 to a pivot point 130 with the table surface 140. This pivot point 130 allows the table to rotate clockwise or counterclockwise around the pivot point 130 as depicted in FIG. 2. The patient (or user) 10 may be turned vertically in either direction. The pivot point 130 may be implemented through various mechanisms, such as a caster, ball bearings or other rotating components. It is understood that the pivot point 130 may also be placed at the end of the front leg 110, at the connection point of the two legs 125. It is further understood that other embodiments of body weight decompression tables allowing for the rotation of the patient 10 are consistent with the present disclosure.

The lumbar support harness 150 goes around the waist of the patient 10 and may be connected to the table. The lumbar support harness 150 is positioned on the table surface 140 to align with the lumbar of the patient 10. At the leg and foot end of the table surface 140 is a leg stabilizer 155. The leg stabilizer 155 and lumbar support belt 150 are connected via an adjustable cable connector 160. In other embodiments, the adjustable cable connection 160 may connect the lumbar support harness to another anchor point on the table 100.

Referring to FIGS. 1 and 2, the user 10 may enter the body weight decompression table 100 of this invention in a semi-vertical position with feet downward 210. The user 10 places his feet and or legs to the leg stabilizer 155. The lumber support harness 150 is also secured around the torso of the user 10. The cable connector 160 is connected between the lumbar support harness 150 and the leg stabilizer 155. The cable connector 160 may be adjusted according the height of the user 10.

The table surface 140 is then rotated around the pivot point 130 so that the feet of the user 10 elevate while the head declines 220. Depending on the physical abilities of the user 10, the table surface 140 may be rotated to different degrees of verticality as shown in 230, 240 and 250. When the appropriate vertical position for the user 10 is reached, the user 10 may remove his feet from the leg stabilizer 155, bend his legs and position his feet in foot straps or other foot retention mechanism, as shown in 230, 240 and 250. These foot straps may advantageously be placed so that the user's legs are in a more bent position. The foot straps may also be compliant, such as rubber or heavy cloth straps. The combination of the lumbar harness attachment, the compliant footstraps and the more relaxed positioning result in a significant improvement in body weight support distribution compared to tables with only a fixed point rigid foot attachment implementation. In such a position, the user 10 body weight will be supported primarily by the lumbar support belt 150, which is reinforced by the cable connector 160 connected to the leg stabilizer 155. The support of the user 10 body weight in this manner at or around the lumbar of the user 10 allows for the user 10 to achieve greater decompression of vertebrae and spine.

Figure 3:
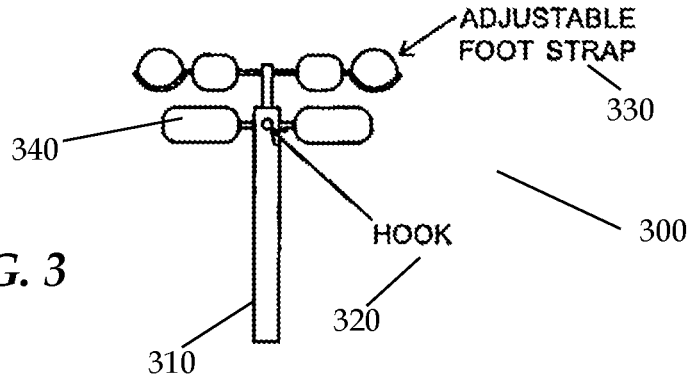
FIG. 3 shows an exemplary embodiment of a leg stabilizer of a body weight decompression table.

Referring to FIG. 3, the leg stabilizer 300 in various embodiments may be comprised of a base 310, which may be leg extension portion of the table system. Connected to the base 310 is a hook 320, and leg stabilizers 340. Also connected to the base 310 are adjustable foot straps 330, or other foot attachment mechanisms. The leg stabilizer 300 attached to one end of the table surface 140 as shown in the leg stabilizer 155 in FIG. 1. Other embodiments of the leg stabilizer 300 may exclude the foot holders 340 or foot strap 330. It is understood that other forms of leg stabilization or foot holding structures may be suitable for use in the disclosed body weight decompression table.

Figure 4:
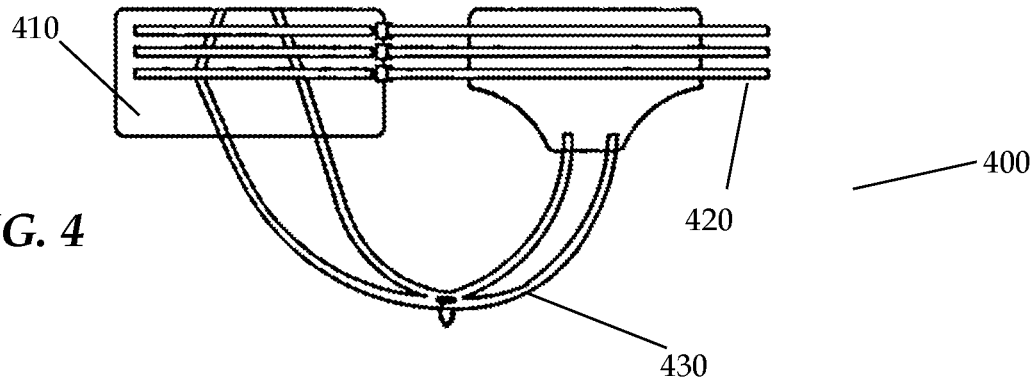
FIG. 4 shows an exemplary embodiment of a lumbar support belt of a body weight decompression table.

Referring to FIG. 4, the lumbar support belt comprises two support surfaces 410. The support surfaces, 410 go around the waist of the patient. One support surface 410 falls on the back of the patient. Otherupport surface 410 goes over the front or stomach of the patient. Connected to the support surfaces 410 are connecting belts 420 for connecting support surfaces 410 and adjustable straps 430 for tightening the support surfaces 410 and connecting belts around a user's lumbar as shown in FIG. 1. The adjustable straps 430 also connect to the adjustable cable 160 shown in FIG. 1. It is understood that other forms of belts or straps may be used for the lumbar support belt in connection with the disclosed body weight decompression table.

Figure 5:
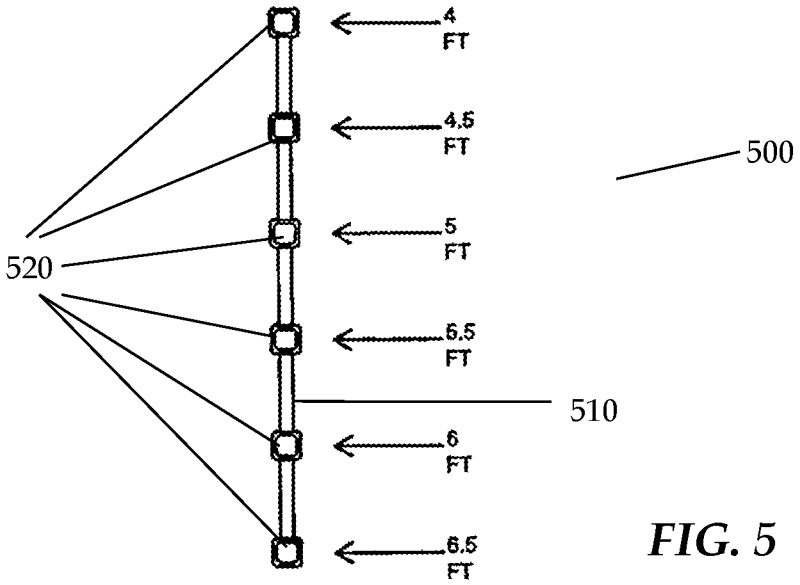
FIG. 5 shows an exemplary embodiment of an adjustable cable connector connecting a foot stabilizer and a lumbar support belt of a body weight decompression table.

Referring to FIG. 5, an adjustable cable connector 500 connects the lumbar support belt to an anchor point, such as the leg stabilizer or another point on the table structure. The adjustable cable connector 500 includes a strap 510. In one embodiment, the adjustable cable connector 500 further includes connectors 520 spaced along the strap 510 to allow for the length and tension of the adjustable cable connector 500 to be adjusted. The connectors 520 may be placed on the hook of the leg stabilizer 320. In other embodiments, the adjustable cable connector may utilize a buckle, traditional belt holes, Velcro, or other known systems for adjusting and securing straps or belts.

A decompression table may serve as a vehicle for enhanced therapy aimed at a variety of postural issues. The use of devices such as lap tops, phones, computers and video games affects posture directly. There are an increasing number of spines that are fixed in forward flexion especially the neck and lower back. This means flexor muscles (muscles in front of the body) become tight therefore pulling the spine forward, creating problems such as postural pain, facet lock syndrome, early arthritis, disc problems and nerve impingement. Stretching and extension is directly applicable to these problems. Suitable stretching may be effective in combination with, and/or the use of, a decompression table as the vehicle for enabling proper stretching positioning.

Figure 6A:
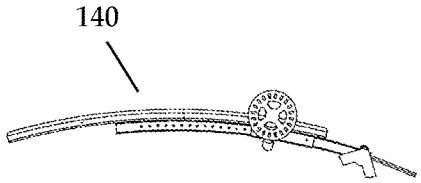
FIGS. 6A and 6B depict an exemplary curved decompression table surface.
Figure 6B:
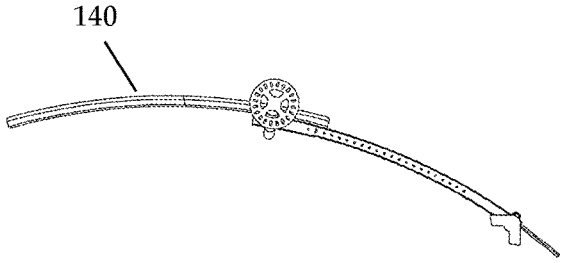
Figure 7A:
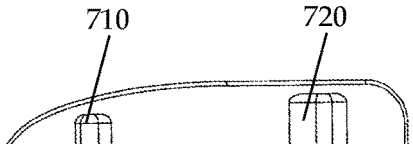
FIGS. 7A and 7B depict exemplary orthotic support elements and their attachment points for a curved decompression table.
Figure 7B:
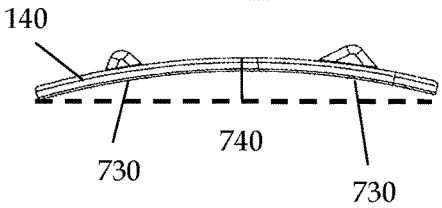

FIG. 6A and FIG. 6B show a stowed (6A) and a deployed (6B) embodiment of an alternative embodiment for a decompression table surface 140 that pre-positions the user in a back-bend stretch position, that is directly applicable to treatment and/or prevention of the front body tightening described above. By configuring the table surface in a curve the body is pre-positioned in a stretch, which is beneficial with or without inverting the table and is particularly effective in conjunction with inversion. A gentle, continuous smooth curve with center diversion from flat, shown as 740 in FIG. 7B maybe beneficial. The deviation 740 may be in the range from 4 to 12 inches from flat with 6 inches a suitable amount for many users.

Some users may benefit from further stretch pre-positioning. In this case orthotic spacers 710 and 720 in FIG. 7A may be placed in the cervical and/or the lumbar area of table surface 140. These spacers may take many forms. One suitable embodiment of the orthotics could be padded blocks, possibly with Velcro on the bottom that are placed on Velcro attachment points 730 in FIG. 7B. Many variations on construction and attachment implementation could be suitable. It may be desirable to keep the orthotics relatively thin, say 4.5 to 6 inches in the lumbar region and 3.5 to 5 inches in the cervical region, and limit their width to the width of the table surface. The height may beneficially be variable with the flexibility of the particular user. A range of blocks either in different sizes or stackable, covering a range of 3 to 6 inches in the cervical area and/or or 2 to 5 inches in the lumbar may be beneficial.

The curved table surface and the optional placement of the different height cervical and lumbar spine orthotics may be configured so that most individuals from different age groups with different degrees of flexibility and rigidity of the spine can utilize and benefit from a pre-positioned stretch in concert with or apart from inversion, using a suitably configured decompression table according to the present disclosure.

Figure 8:
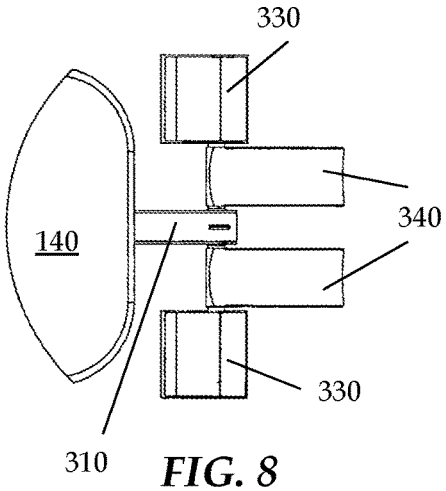
FIG. 8 shows details of an alternative exemplary foot and leg element attachment region of a decompression table.

FIG. 8 shows details of alternative embodiments of exemplary leg and foot elements. The calf supports, or leg stabilizers, 340 at the end of the leg support structure allow the user to comfortably invert without worrying about losing balance while standing. Once the user has reached their desired inclination angle, they can move their feet into the foot holders 330, which may be foot straps or c-cup/sling foot holders, to assume the proper therapeutic posture. This is beneficial because once the feet are in the c-cup/sling it allows the knees to bend and bent knees will relax the para-spinal muscles and allow maximum pull/decompression of the lower back spine and vertebral discs. Leg-calf support end may also include a hook for the restraint cable to connect the lumbar harness to the lower area of the leg/calf support.

Figure 9A:
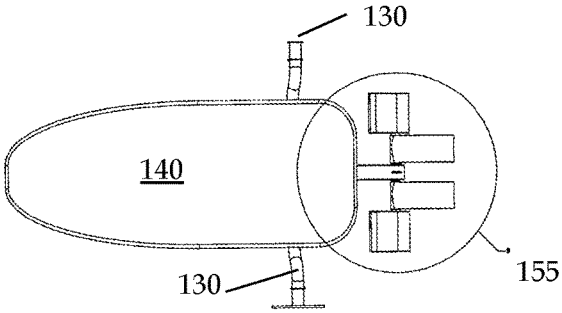
FIGS. 9A and 9B depict an exemplary embodiment of a decompression table.
Figure 9B:
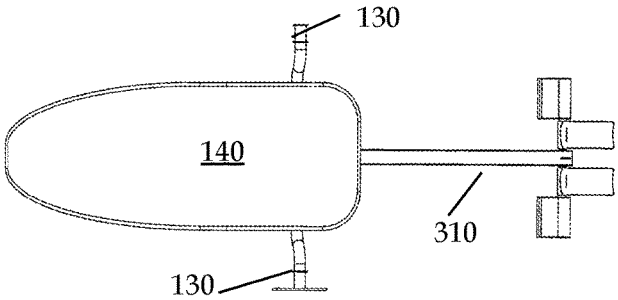

FIGS. 9A and 9B show deployed and stowed configurations of an exemplary decompression table. The upper body support portion 140 is mated with a leg extension portion 310 for the leg-foot attachment element forming the user connection portions of the table. The leg extension portion 310 may be configured to slide behind the upper body support 140 for storage. The user support portions and the leg extension portions are joined at the pivot point 130, which forms the axis around which the table pivots for inversion. Pivots 130 may remain fixed during stowage. Generally the back bend curve 740 is applied to the user support portion 140, although the leg extension portion 310 may also be curved to allow for more compact stowage. Leg extension portion may be configured to extend from user support portion 140 in increments, for example 1 inch increments, to adjust for the size of the user.

Figure 10A:
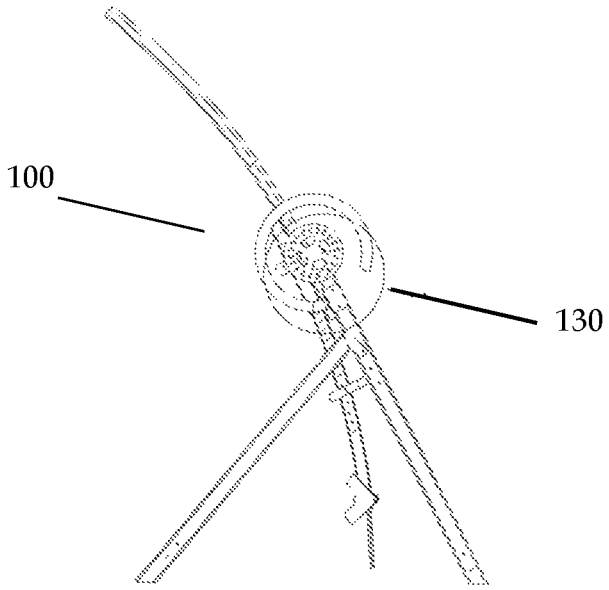
FIGS. 10A, 10B and 10C show deployed and stowed configurations for an exemplary decompression table.
Figure 10B:
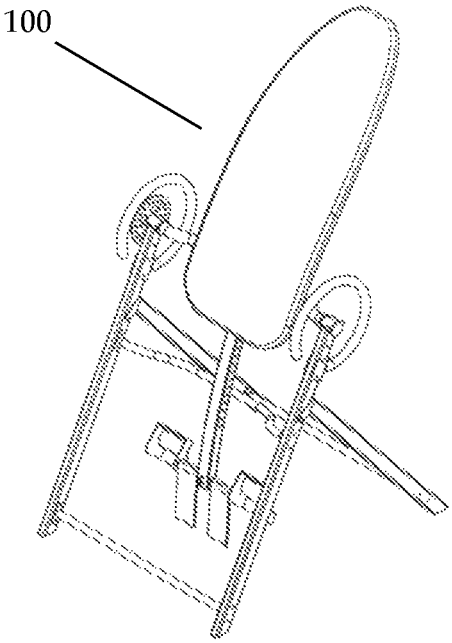
Figure 10C:
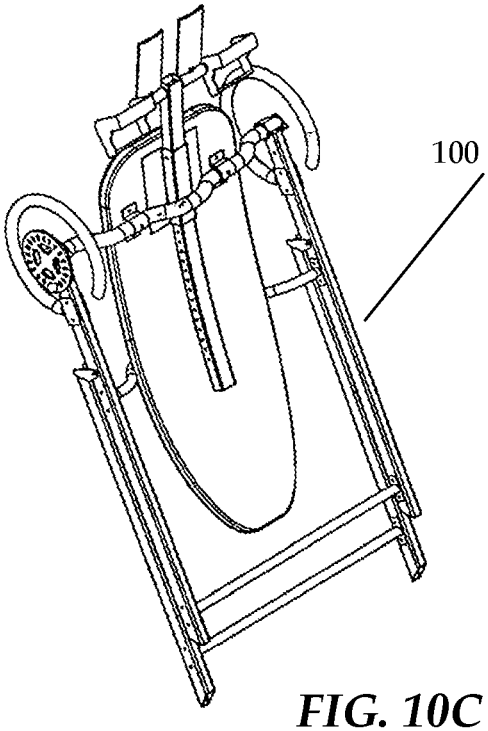

FIGS. 10A, 10B, and 10C show various stowed and deployed configurations of an exemplary invertible, curved decompression table. Various implementation details of the exemplary table will now be discussed.

One implementation for adjustable pivot point 130 is an indexed locking wheel as shown in FIG. 10A. A particular implementation of an indexed locking wheel may allow for positional control of the table. The wheel may be configured to be locked at 18-degree increments by the user at any times during inversion. This allows users of different confidence levels to secure themselves in as severe of a position that they are comfortable with.

The table may be implemented with a light material such as fiberglass plate or carbon fiber and may designed with curved radius to assist the user to traction and extend the spine. The table surface 140 may be lined with velcro either fully or covering areas of interest such as lumbar and cervical, to allow attachment of the cervical and lumbar spine orthotics to further adjust the curvature of the neck and low back. The curved table and optional orthotics may be effective in a flat/horizontal position without inversion or with inversion to users' comfort level. The support legs may be designed to prop against each other without the need for locking pins or screws. When the user wants to store the apparatus, the legs can be folded together to a near-flat profile. The legs and other parts may be made of very light materials as well, including aluminum, titanium and other suitable materials.

The table may be designed to be fold to a near-flat shape to allow easy transportation and storage. The cross-members may be contoured to allow the upper body support portion to rest in between the folded legs. In one exemplary implementation, the table is made up of aluminum and reinforced fiberglass, which makes it light and durable. Because of the low weight and size the portability, assembly may be straightforward without the need of any pins and screws. When stowed, the exemplary table is approximately 4-4.5 feet long and weighs 20-25 pounds and can be carried in a carry-on bag so a user can transport it easily.

Figure 11A:
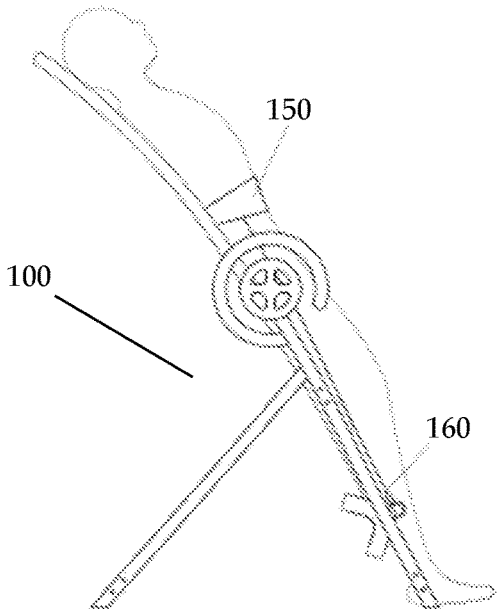
FIGS. 11A, 11B, 11C, and 11D show various stages a method for using an exemplary decompression table.
Figure 11B:
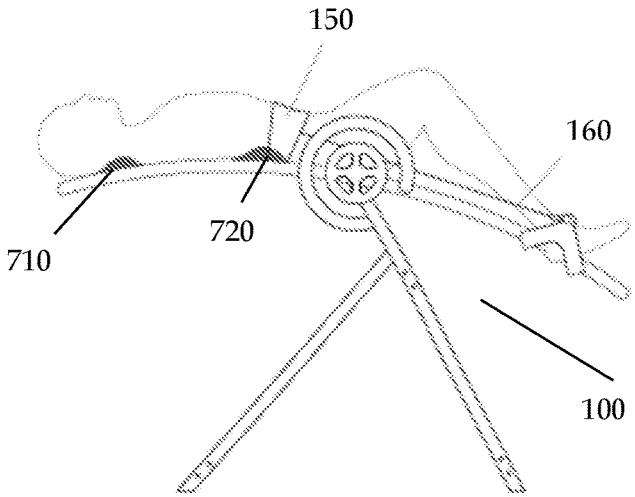
Figure 11C:
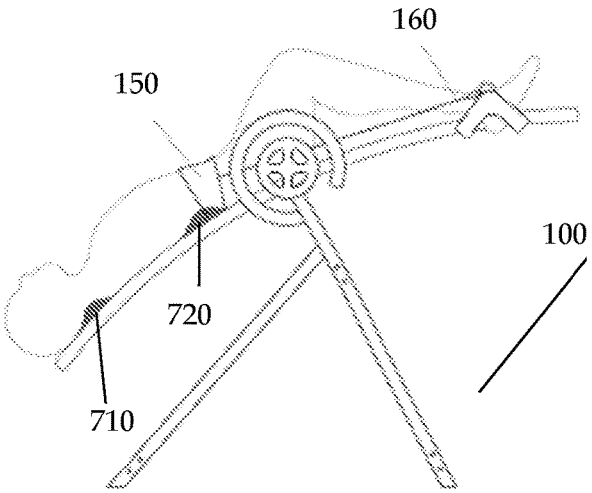
Figure 11D:
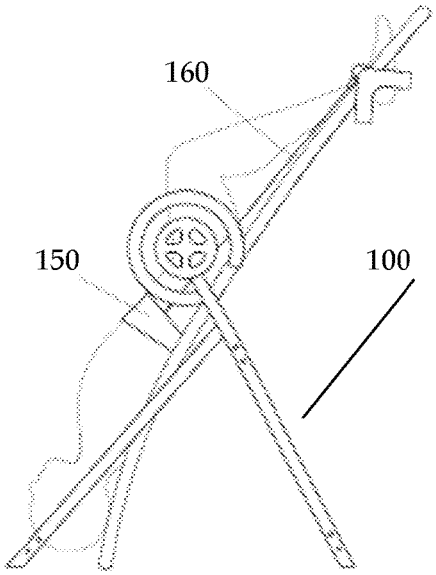

FIGS. 11A, 11B, 11C, and 11C show operational aspects of a method for using an exemplary decompression table, of the type shown in FIGS. 6-10. In FIG. 11A the restraint cable 160 is connected to the harness 150 and to the leg extension with the table in an upright position and the user standing on the ground with legs in a leg stabilizer on the leg extension. In FIGS. 11B and 11C the table may be rotated first to a substantially horizontal position while placing the user's feet optionally in attachment elements in a bent knee position and inserting optionally at least one of a cervical and a lumbar spacing orthotic between the user and the table. In FIG. 11D the table may be inverted toward an upright position to the extent desirable and comfortable for a particular user.

The embodiments described herein are exemplary. Modifications, rearrangements, substitute material, alternative elements, etc. may be made to these embodiments and still be encompassed within the teachings set forth herein.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," "involving," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Disjunctive language such as the phrase "at least one of X, Y or Z," unless specifically stated otherwise, is otherwise understood with the context as used in general to present that an item, term, etc., may be either X, Y or Z, or any combination thereof (e.g., X, Y and/or Z). Thus, such disjunctive language is not generally intended to, and should not, imply that certain embodiments require at least one of X, at least one of Y or at least one of Z to each be present.

The terms "about" or "approximate" and the like are synonymous and are used to indicate that the value modified by the term has an understood range associated with it, where the range can be ±20%, ±15%, ±10%, ±5%, or ±1%. The term "substantially" is used to indicate that a result (e.g., measurement value) is close to a targeted value, where close can mean, for example, the result is within 80% of the value, within 90% of the value, within 95% of the value, or within 99% of the value.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C.

While the above detailed description has shown, described, and pointed out novel features as applied to illustrative embodiments, it will be understood that various omissions, substitutions, and changes in the form and details of the devices and components illustrated can be made without departing from the spirit of the disclosure. As will be recognized, certain embodiments described herein can be embodied within a form that does not provide all of the features and benefits set forth herein, as some features can be used or practiced separately from others. All changes which come within the meaning and range of equivalency of the claims are to be embraced within their scope.

The invention claimed is:

1. A body weight decompression table comprising:

a leg extension portion connected to a user support table surface at an axis point, the table extension and user support portions configured to be pivoted around the axis point in controllable increments;

a lumbar support harness configured to be secured around a user's waste;

a cable, whose length is adjustable, connected to the lumbar support harness at one end and anchored to the leg extension portion at the other end; and, leg and foot elements disposed at one end of the table surface, comprising;

a leg stabilizer configured for initial user foot placement on the table surface to position the user in an initial leg straight alignment for set-up; and, at least one set of footstraps placed closer to the patient than the leg stabilizers, configured for user foot alignment for therapeutic benefit on the table in a leg bent configuration;

wherein the user support table surface is curved, the curve comprising a continuous smooth curve with a center deviation from flat of between 4 and 12 inches.

2. The table of claim 1 wherein the center deviation from flat is 6 inches.

3. The table of claim 1 wherein the table surface comprises attachment points for orthotics in at least one of the cervical region of the surface and the lumbar region of the table surface wherein the orthotics comprise padded structures configured to raise the effective user-to-table separation in at least one of the cervical and lumbar regions of the table surface.

4. The table of claim 3 wherein the orthotics are less than the table surface width in width, and the lumbar region orthotic is between 4.5 to 6 inches in length and the cervical region orthotic is between 3.5 and 5 inches in length.

5. The table of claim 3 wherein the cervical orthotics are between 3 and 6 inches in height and the lumbar orthotics are between 2 and 5 inches in height.

6. The table of claim 1 wherein the table comprises support legs and a pivot mechanism at the axis point configured to lock and unlock the table at each incremental rotation point.

7. The table of claim 6 wherein table components including surface, legs, and pivot mechanism are made from lightweight materials including, at least one of fiberglass, aluminum, carbon fiber, and titanium.

8. The table of claim 1 wherein the harness cable comprises a series of hooking points disposed along its length configured to mate with a hook on the table thereby providing cable length adjustment.

9. The table of claim 6 wherein the user support portion, leg extension portion and table support legs fold and collapse into a compact stowed configuration.

* * * * *